US008070374B2

(12) United States Patent
Gueret

(10) Patent No.: US 8,070,374 B2
(45) Date of Patent: Dec. 6, 2011

(54) APPLICATOR WITH PRODUCT RESERVE, IN PARTICULAR FOR NAIL VARNISH

(75) Inventor: Jean-Louis H. Gueret, Paris (FR)

(73) Assignee: L'Oreal, Paris (FR)

( * ) Notice: Subject to any disclaimer, the term of this patent is extended or adjusted under 35 U.S.C. 154(b) by 1361 days.

(21) Appl. No.: 11/611,684

(22) Filed: Dec. 15, 2006

(65) Prior Publication Data

US 2007/0140773 A1 Jun. 21, 2007

Related U.S. Application Data

(60) Provisional application No. 60/755,145, filed on Jan. 3, 2006.

(30) Foreign Application Priority Data

Dec. 15, 2005 (FR) ..... 05 53887

(51) Int. Cl.
*A45D 33/00* (2006.01)

(52) U.S. Cl. ..... 401/130; 401/129; 401/126

(58) Field of Classification Search ..... 401/126, 401/128–130
See application file for complete search history.

(56) References Cited

U.S. PATENT DOCUMENTS

| | | | | |
|---|---|---|---|---|
| 2,168,179 | A * | 8/1939 | Tobey | 401/202 |
| 2,681,463 | A * | 6/1954 | Gordon | 401/128 |
| 2,990,563 | A * | 7/1961 | Davidson | 401/126 |
| 4,841,996 | A | 6/1989 | Gueret | |
| 4,850,727 | A * | 7/1989 | Gueret | 401/126 |
| 6,033,143 | A | 3/2000 | Gueret | |
| 6,059,473 | A * | 5/2000 | Gueret | 401/129 |
| 6,067,997 | A | 5/2000 | Gueret | |
| 6,220,254 | B1 | 4/2001 | Gueret | |
| 6,312,182 | B1 * | 11/2001 | Dumler | 401/270 |
| 2003/0235454 | A1 | 12/2003 | Gueret | |

FOREIGN PATENT DOCUMENTS

| | | |
|---|---|---|
| EP | 0 875 169 | 11/1998 |
| EP | 0 916 282 | 5/1999 |
| EP | 1 407 685 | 4/2004 |
| EP | 1 440 629 | 7/2004 |
| EP | 1 563 759 | 8/2005 |
| FR | 2 412 287 | 12/1977 |
| FR | 2 603 780 | 3/1988 |
| WO | WO 2004/062422 | 7/2004 |

OTHER PUBLICATIONS

U.S. Appl. No. 11/611,617, filed Dec. 15, 2006, Gueret.

* cited by examiner

*Primary Examiner* — David Walczak
(74) *Attorney, Agent, or Firm* — Oblon, Spivak, McClelland, Maier & Neustadt, L.L.P.

(57) ABSTRACT

A packaging and application device that includes a composition and an applicator. The applicator includes an application element and a rod. The rod includes a first portion that includes at least two branches. The at least two branches form at least one cavity therebetween, the at least one cavity opens onto an outer surface of the rod, and the cavity includes a non-constant cross-section along the length of the rod.

67 Claims, 9 Drawing Sheets

APPLICATOR WITH PRODUCT RESERVE, IN PARTICULAR FOR NAIL VARNISH

CROSS-REFERENCE TO RELATED APPLICATIONS

This document claims priority to French Application Number 05 53887, filed Dec. 15, 2005 and U.S. Provisional Application No. 60/755,145, filed Jan. 3, 2006, the entire content of which are hereby incorporated by reference.

FIELD OF THE INVENTION

The present invention concerns packaging and application devices. The device can be particularly advantageous, for example, for compositions to be applied to the nails, skin, including that of the eyelids, or lips.

BACKGROUND OF THE INVENTION

Discussion of Background

EP 1 407 685 describes a device including a container containing a nail varnish and an applicator including a rod provided at one end with a housing accommodating an application element constituted by a tuft of hair. The rod includes opposite longitudinal grooves each channeling the flow of the composition to a middle region of the application element.

U.S. Pat. No. 6,033,143 describes an applicator including a rod having a flexible portion formed from two flexible branches. Such an applicator does not have a large amount of autonomous operation.

U.S. Pat. No. 4,841,996 describes an applicator including a sheath extending around the rod so as to form a capillary reserve and increase the autonomous operation of the applicator. The presence of such a sheath increases the manufacturing cost of the applicator.

There is a need to have an applicator which is both simple to produce and which makes it possible to obtain a relatively large amount of autonomous operation.

The invention aims to meet this need.

SUMMARY OF THE INVENTION

It is an object of the present invention, according to one of its aspects, to provide a packaging and application device that includes a composition and an applicator. The applicator includes an application element and a rod. The rod includes a first portion that includes at least two branches. According to a preferred example, the at least two branches form at least one cavity therebetween, the at least one cavity opens onto an outer surface of the rod, and the cavity includes a non-constant cross-section along the length of the rod.

The composition can be a composition suitable for application on the nails, skin, or lips, for example.

The first portion can be, for example, disposed in a container in the closed position of the device, such that the portion and the container are configured so that a flow of air is maintained around the portion during a change from the closed position to an open position, in which the application element is taken out of the container.

The portion can be substantially non-deformable during application of the composition. The portion can be substantially non-deformable during the change from the closed position to the open position.

Advantageously, a maximum cross-section of the portion can be contained within the internal cross-section of the smallest of the cross-sections of the container passed through by the portion during the change from the closed position to the open position. Thus, the product that has come to fill the cavity or cavities is not drawn up and retained in the container by a suction effect.

The cross-section of the cavity can, for example, have a narrowed portion. The cavity or cavities make it possible to retain a reserve of composition by capillary action and to supply the application element externally with the composition. The autonomous operation of the applicator is thus increased and the cavity or cavities are, for example, made so as to contain an amount of composition making it possible to make up five, perhaps even ten, nails without having to reload the applicator, which facilitates the treatment of the nails and can make it possible to reduce the losses of solvent by evaporation, if applicable.

The applicator can make it possible to deposit a thick single layer of composition, which can provide more brilliance, depth, color and/or better attachment to the nail, for example.

The cavity or cavities are preferably through cavities, in order to increase the amount of composition capable of being retained by capillary action, and also, if applicable, allow the user to see the level of composition in the cavity or cavities more easily.

The rod can include, at one end, a housing in which the application element is fitted.

The application element can also be molded, at least partially, with the rod.

The rod can have a cross-section, along the aforementioned portion, of overall oblong shape, for example, elongated in a median plane.

The cavity or cavities can extend, for example, over more than 10 mm, for example over more than half the length of the rod. The cavity or cavities can extend at a distance from a distal portion of the rod, for example, more than 10 mm from this distal portion. The cavity or cavities can include at least one slot extending, for example, over more than 10 mm, for example over more than half the length of the rod.

The slot or slots can open at the top into at least one hole wider than the slot, this hole having, for example, a substantially circular shape when the rod is observed from the front. The applicator can have two slots, for example lateral ones, meeting at the end.

The rod can include, between the cavity or cavities and the application element, at least one longitudinal groove. This groove can extend along a distal portion of the rod which furthermore defines the housing accommodating the application element. The slot or one of the slots can open onto several longitudinal grooves.

The slot or slots can also open onto the outer surface of a distal portion of the rod devoid of longitudinal grooves, for example, of flat external shape.

There is perhaps a single cavity.

The cavity or cavities can extend, over at least part of their length, on only a single side of the rod. For example, the slot or slots can open onto only one side of the rod.

According to an example, the applicator can include two branches. The branches can have facing surfaces that are not entirely plane. The distance between the facing surfaces can pass through a minimum in a median plane of symmetry for the rod. The distance between the facing faces along the slot is, for example, less than or equal to 2 mm, preferably 1.5 mm, for example, lying between 0.5 mm and 1.5 mm, for example, of the order of 1 mm.

The rod can have, along the aforementioned portion, a larger transverse dimension greater than or equal to 5 mm, preferably 6 mm, more preferably 7 mm. This can make it possible to make a cavity having relatively large dimensions and can increase the amount of product which is deposited on the rod when, for example, it is immersed in a container containing the composition.

The cavity or cavities can be delimited at the bottom by at least one inclined surface extending towards the outside and downwards, or by two inclined surfaces that are symmetrical with respect to a median plane. The inclined surface or surfaces can facilitate the flow of the composition contained in the cavity or cavities towards the application element, by leading the composition towards the surface of the rod.

The aforementioned portion can have a cross-section decreasing overall towards the distal end of the rod.

By way of example, the rod can be made in a single piece by molding a thermoplastic material.

The rod can also include, for example, three branches forming the cavity or cavities between them.

The application element can include a bunch of hairs, flocking, felt, foam, sintered material or a textile.

The application element can be fixed otherwise than in a housing of the rod and can, for example, partially externally cover the rod.

The application element can also be molded at least partially in a single piece with the rod. Such an application element can be flocked or covered with a fabric or foam.

The application element can have various shapes and can have, for example, a longitudinal axis making a non-zero angle with that of the rod. The application element can also extend not entirely in alignment with the rod, for example by being curved and/or making an angle with the longitudinal axis of the rod.

The applicator can include a hinge, which can give more flexibility to the application, for example, a film hinge.

The housing accommodating the application element need not communicate with the cavity or cavities, the supplying of the application element taking place from the outside of the rod.

The applicator can include a sheath surrounding the rod, in order, for example, to increase the amount of product with which the rod is loaded.

The bunch of hairs can have, in cross-section, an overall flat, rectangular, square, oval, circular, wavy or curved shape. The bunch can include a mixture of hairs and/or wavy hairs. The bunch can include, for example, straight hairs and wavy hairs and/or wavy hairs having different wave frequencies.

The composition can be contained in a container. The applicator can be fixed in a removable manner on this container and the applicator can, for example, be configured to close the container in a sealed manner. The container can be provided or not with a wiping member.

A second container can also be fixed to the applicator during application. The second container can then include, for example, a dispensing device such as a pump or valve. The second container can also include at least one flexible wall which the user can press in order to dispense the composition. In this example, the container forms a cover which can be fixed on the applicator around the application element in the closed position.

The composition can be for application on the nails, for example.

As should be apparent, the invention can provide a number of advantageous features and benefits. It is to be understood that, in practicing the invention, an embodiment can be constructed to include one or more features or benefits of embodiments, described herein, but not others. Accordingly, it is to be understood that the preferred embodiments discussed herein are provided as examples and are not to be construed as limiting, particularly since embodiments can be formed to practice the invention that do not include each of the features of the described examples.

BRIEF DESCRIPTION OF THE DRAWINGS

A better understanding of the invention will be gained from reading the following description in conjunction with the accompanying figures. The figures are offered purely as a guide and by way of example, and in no way limit the invention.

Figure 1:
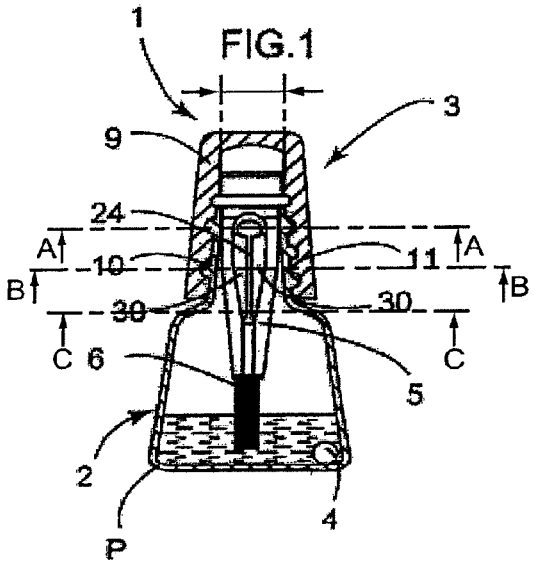
FIG. 1 is a partial and schematic longitudinal section of a packaging and application device according to one example embodiment of the invention.
Figure 2:
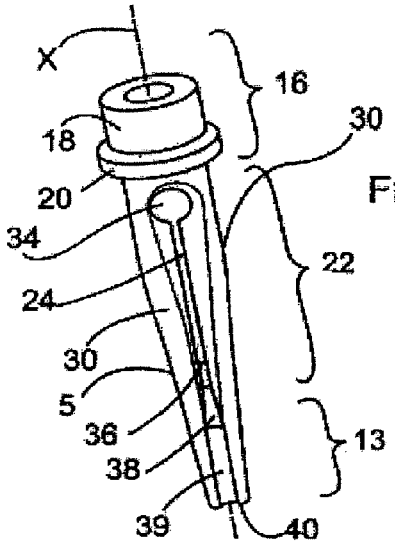
Figure 45:
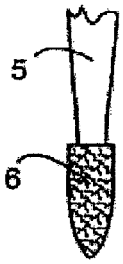
Figure 3:
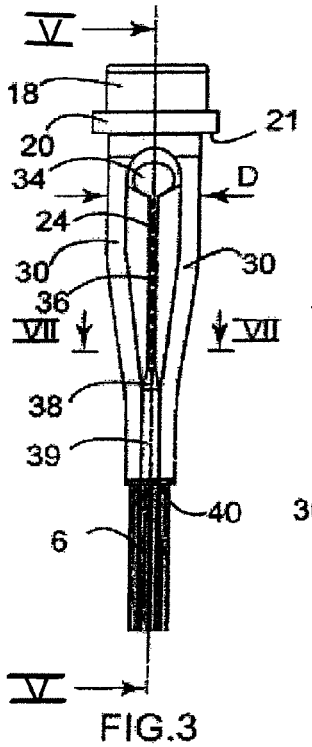
Figure 6:
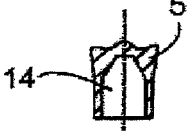
Figure 7:
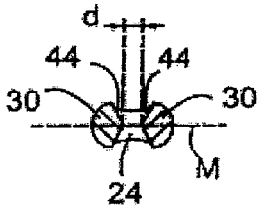
Figure 4:
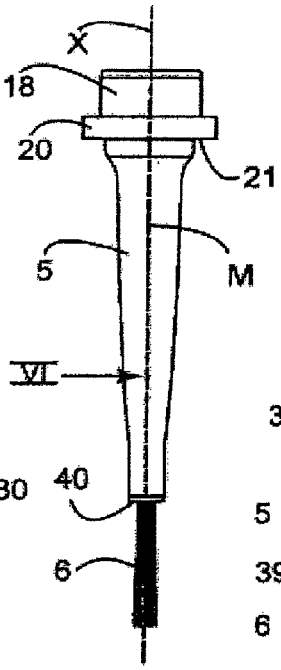
Figure 46:
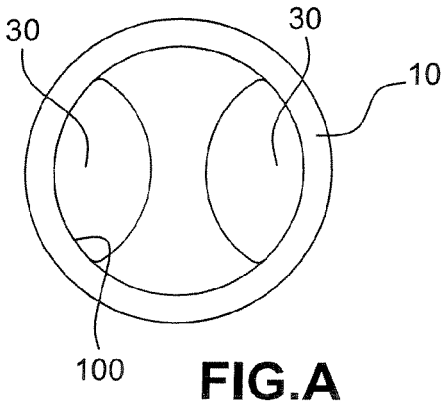
Figure 46:
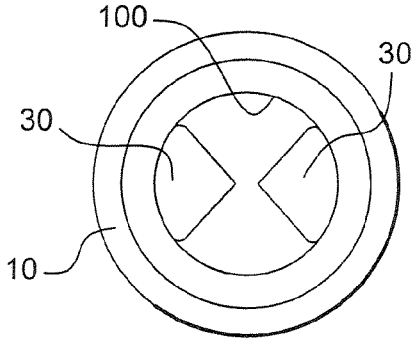
Figure 46:
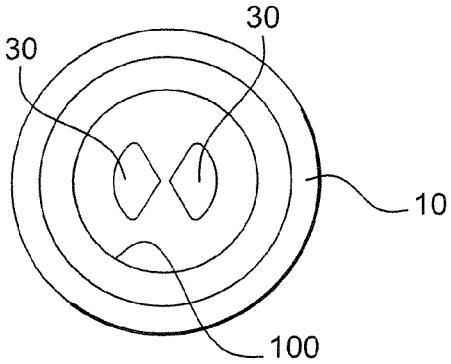
Figure 46:
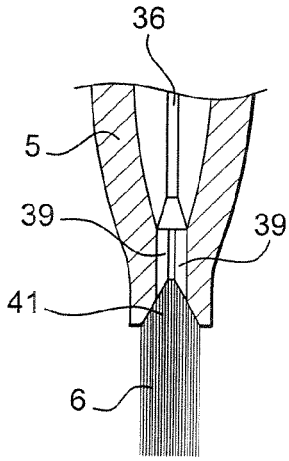
Figure 5:
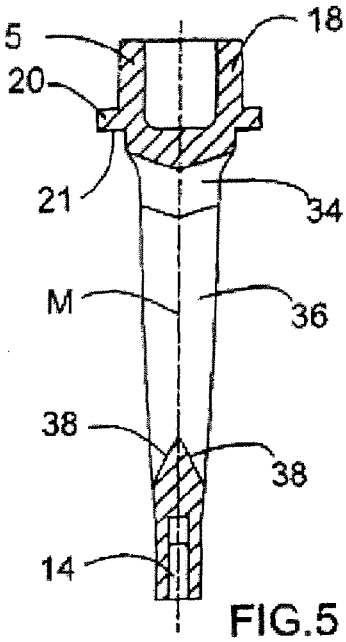
Figure 8:
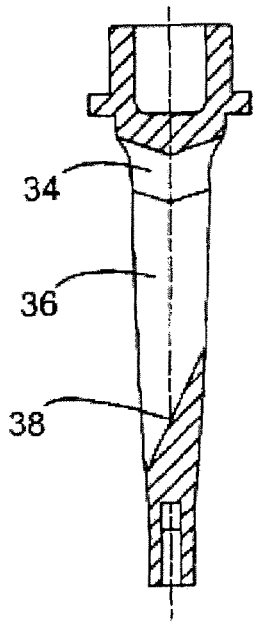
Figure 42:
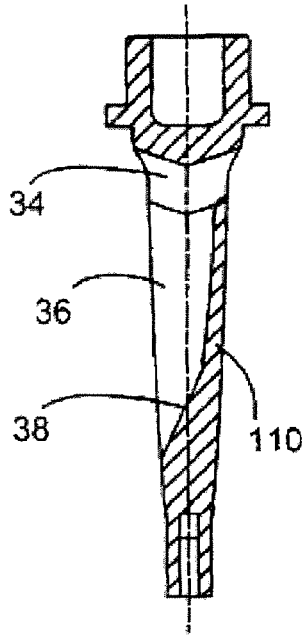
Figure 9:
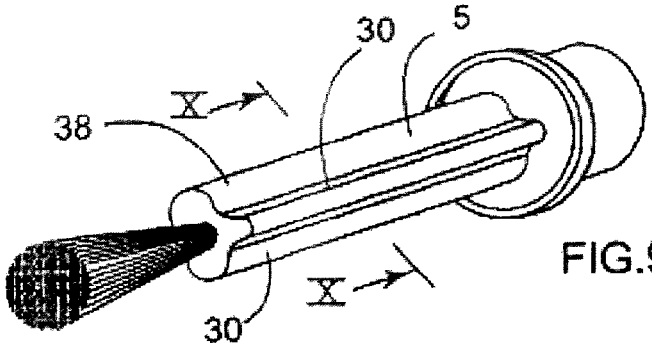
Figure 10:
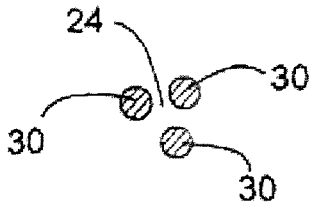
Figure 38:
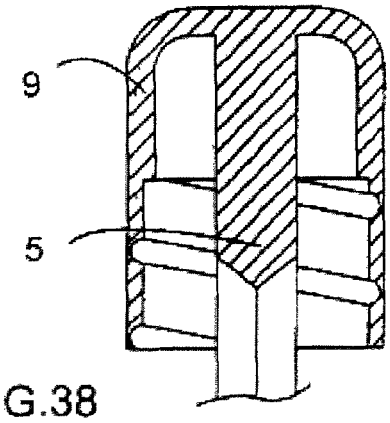
Figure 26:
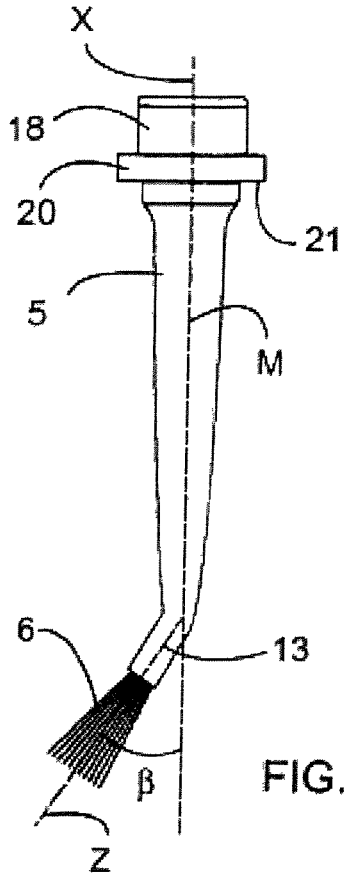
Figure 27:
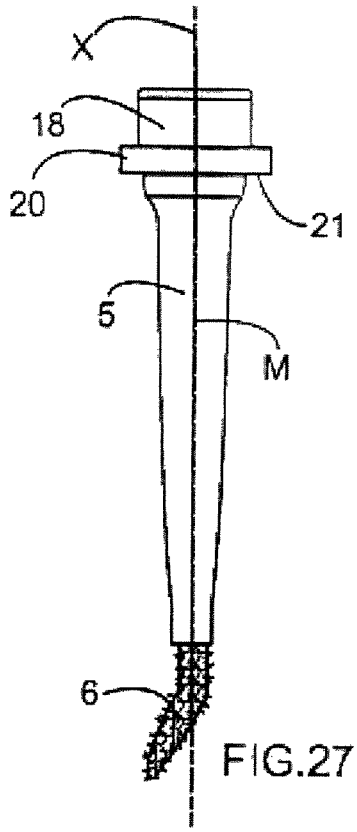
Figure 29:
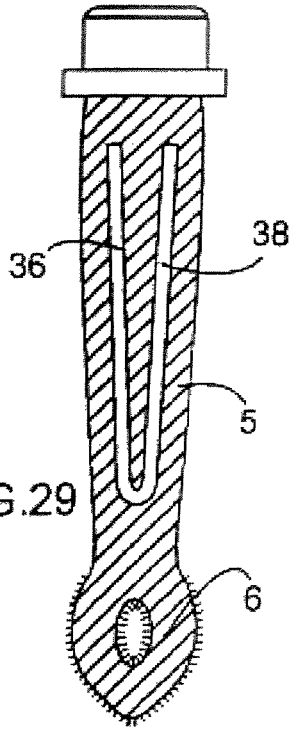
Figure 28A:
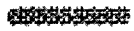
Figure 28B:
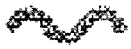
Figure 28C:
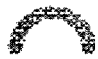
Figure 28:
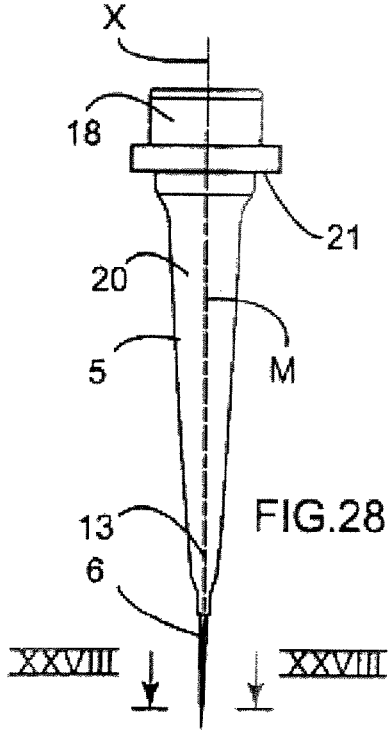
Figure 30:
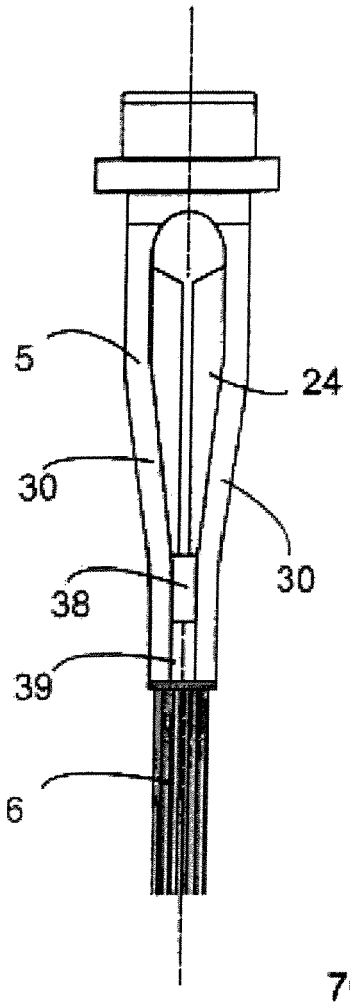
Figure 31:
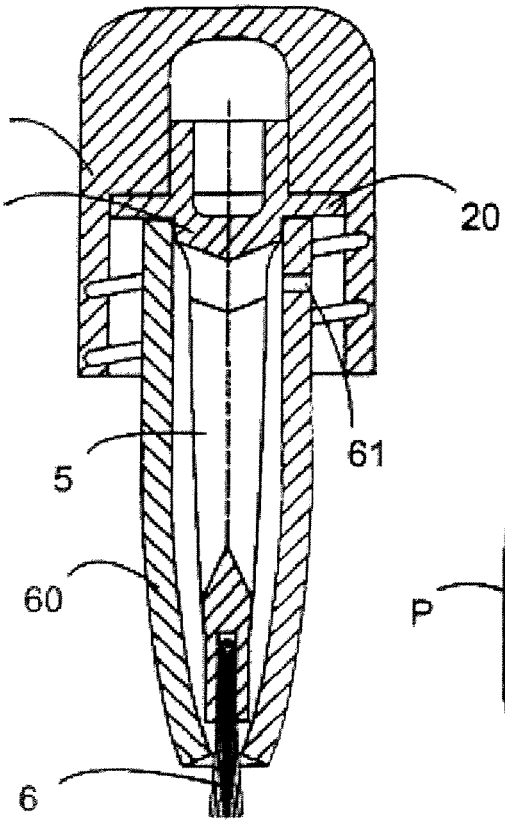
Figure 32:
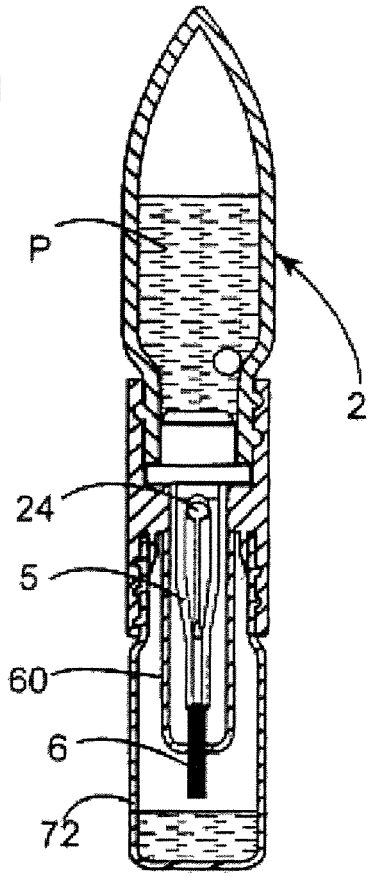
Figure 33:
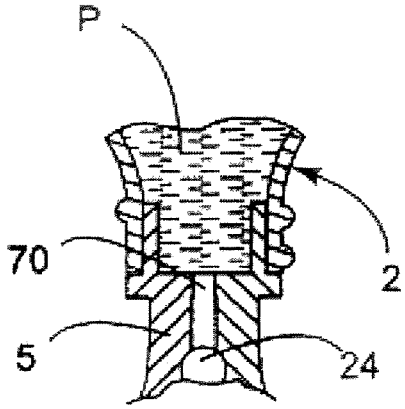
Figure 34:
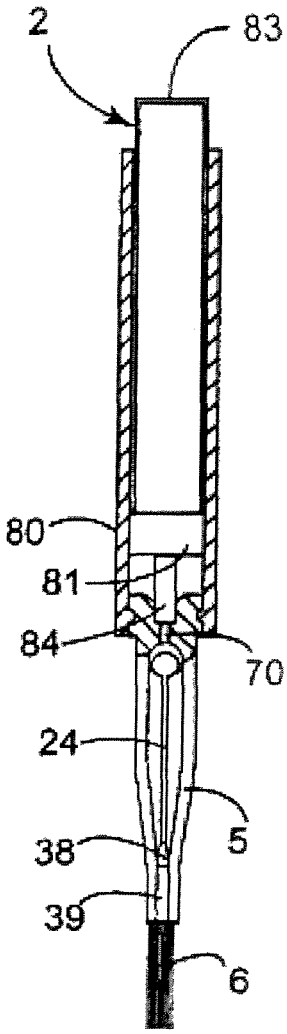
Figure 36:
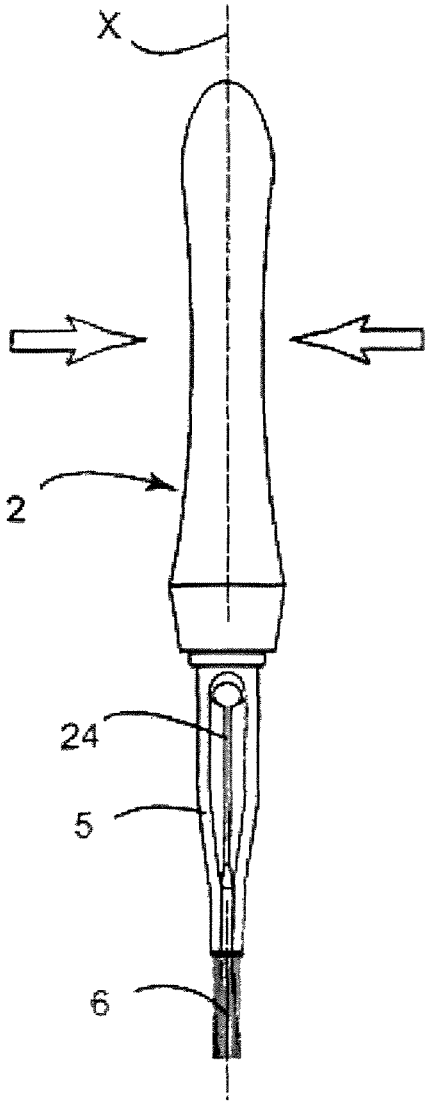
Figure 39:
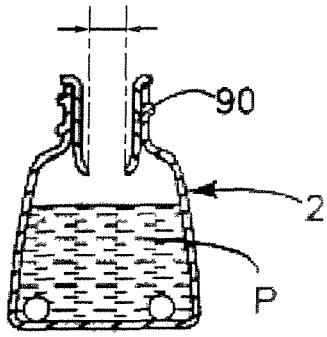
Figure 40:
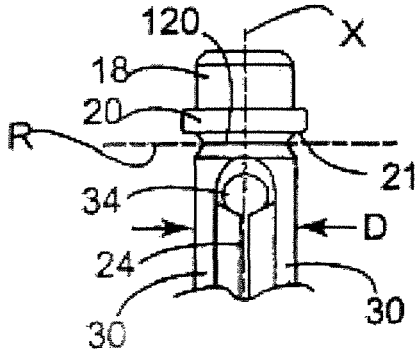
Figure 37:
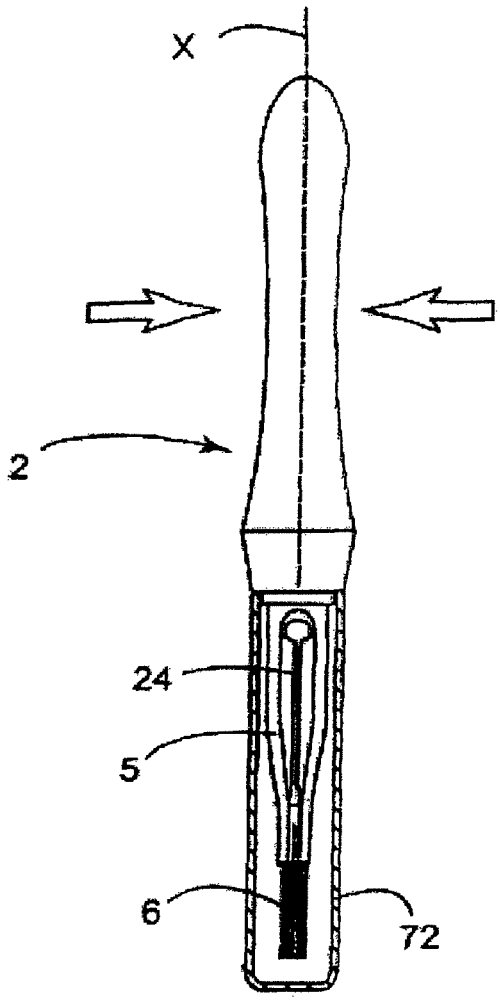
Figure 35:
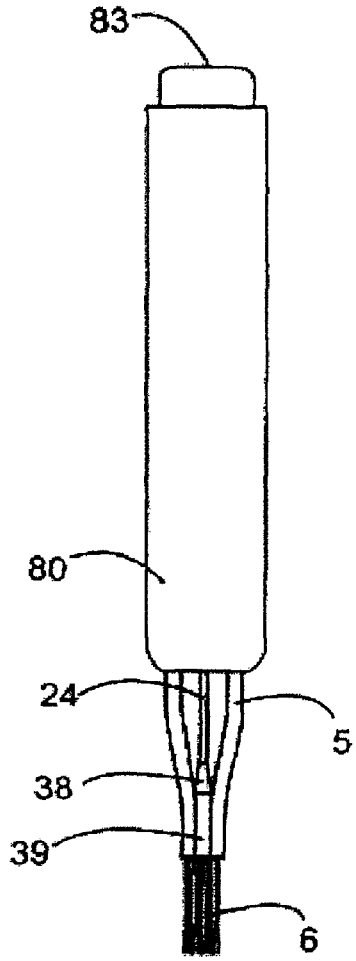
Figure 41:
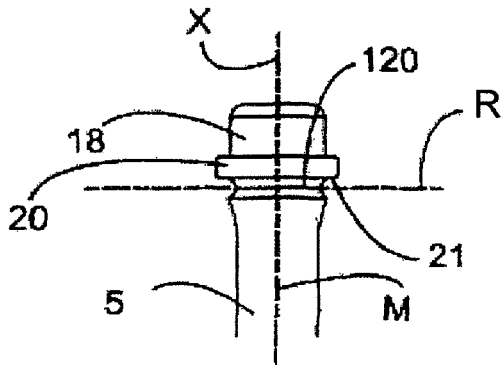

FIGS. A, B and C are cross-sections along respectively A-A; B-B and C-C of FIG. 1;

FIG. 2 depicts a perspective view of the rod of the device of FIG. 1 in isolation;

FIG. 3 depicts in elevation the rod and the application element;

FIG. 4 is a side view of the rod;

FIG. 5 is a longitudinal section along V-V of FIG. 3;

FIG. 6 is a partial longitudinal section of the end of the rod along VI of FIG. 4;

FIG. 7 is a cross-section along VII-VII of FIG. 3;

FIG. 8 is a view similar to FIG. 5 of a variant implementation;

FIG. 9 depicts a perspective view of a rod and an application element in isolation according to one example of the invention;

FIG. 10 is a cross-section along X-X of FIG. 9;

FIGS. 11 to 14 are views similar to FIG. 3, illustrating variant implementations of the application element;

FIGS. 15 to 21 are views similar to FIG. 6 of variant implementations of the housing of the rod accommodating the application element;

FIGS. 22 to 25 are other views similar to FIG. 3 of variant implementations of the application element;

FIGS. 26 to 28 are views similar to FIG. 4 of variant implementations of the rod and the application element;

FIGS. 28A to 28C are sections along XXVIII-XXVIII of FIG. 28, of variant implementations of the bunch of hairs;

FIG. 29 is a longitudinal section of the rod;

FIG. 30 is a view similar to FIG. 3 of another variant implementation of the rod;

FIG. 31 depicts a variant implementation of the applicator, in longitudinal section;

FIG. 32 depicts, in partial longitudinal section, a variant implementation of the packaging and application device;

FIG. 33 depicts, in partial axial section, an implementation detail of the device of FIG. 32;

FIG. 34 is a schematic partial longitudinal section of a variant implementation of the device;

FIG. 35 is a view in elevation of a variant implementation of the device of FIG. 34;

FIG. 36 depicts in elevation another variant implementation of the device;

FIG. 37 depicts a variant of the device of FIG. 36;

FIG. 38 is a partial longitudinal section of an applicator variant;

FIG. 39 is a longitudinal section of a container variant;

FIGS. 40 and 41 are partial views, similar to respectively FIGS. 3 and 4, of variant implementations of the rod;

FIG. 42 is a view similar to FIG. 5 of a variant implementation of the rod;

FIGS. 43 to 45 and 47 depict variant implementations of the lower end of the applicator; and FIG. 46 depicts a variant implementation of the distal end of the rod.

DETAILED DESCRIPTION OF THE PREFERRED EMBODIMENTS

Referring now to the drawings, like reference numerals are utilized to designate identical or corresponding parts throughout the several views.

FIG. 1 depicts a packaging and application device including a container 2 and an applicator 3 capable of being separated from the container 2 at the time of use.

The container 2 contains a composition P which is, for example, a product intended for application on the nails, for example, a nail varnish. The invention is not limited to one particular cosmetic composition, and the composition P can, for example, be a product intended to be applied to other keratinous materials, for example, the skin or lips.

The container 2 can contain one or more balls 4 making it possible to homogenize the composition P before application.

The applicator 3 includes a rod 5 with axis X which has been depicted in isolation in FIG. 2, having at one end an application element 6 and connecting at its other end to a gripping member 9 which also constitutes, in the described example, a member for closing the container 2.

The applicator 3 can be fixed in various ways on the container 2 and, in the example illustrated, the container 2 includes an externally threaded neck 10 and the gripping member 9 includes an internally threaded mounting skirt 11, arranged to screw onto the neck 10.

The sealing of the closure of the container 2 is, for example, provided by the rod 5 but, in a variant, this sealing can be obtained differently, for example, by a sealed application of the gripping member 9 on the container 2.

The rod 5 can be fixed in various ways on the gripping member 9, being, for example, press-fitted and/or with a snap-on fixing.

In a variant illustrated in FIG. 38, the gripping member 9 and the rod 5 are made in a single piece by molding plastic material.

The applicator 3 can also include a sub-capsule between the rod 5 and the gripping member 9, in a non-illustrated variant.

The rod 5 includes a distal portion 13 (shown in FIG. 2) provided internally with a housing 14, that can be seen in FIGS. 5 and 6, and a proximal portion 16 including a tubular skirt 18 which is used for fixing in the gripping member 9.

The skirt 18 is connected at its base to a platform 20 which can come to rest by a lower face 21 against an upper section of the neck 10 of the container 2 when the applicator 3 is in place thereon. The neck 10 can be made with a tapering lip at its upper end, fitting over the lower face 21, which makes it possible to obtain improved sealing.

The rod 5 includes, between the proximal 16 and distal 13 portions, an intermediate portion 22 which includes two branches 30 defining between them an elongated cavity 24 along the axis X.

As depicted in Figures A, B and C, the cross-sections of the intermediate portion 22 are all contained within the smallest of the cross-sections of the container 2, in this case the cross-section of the neck 10 at the upper section. These cross-sections are identified perpendicular to a main elongation axis of the intermediate portion 22 when the applicator is mounted on the container 2.

In the described example, the cavity 24 includes in the upper part a hole 34 with axis perpendicular to a median plane M for the rod 5, this hole 34 being continued at the bottom by a slot 36 extending, for example, over more than half the length of the rod 5.

The slot 36 is delimited at the bottom by two inclined surfaces 38 which can be seen in FIG. 5, for example, and which are, for example, symmetrical with one another with respect to the median plane M.

The inclined surfaces 38 are each continued at the bottom by a longitudinal groove 39 extending on one side of the distal portion 13 as far as substantially the lower end 40 of the rod 5, as can be seen in FIG. 3, for example.

As depicted in FIG. 46, the distal end 40 can include a notch 41, for example, V-shaped, formed in the continuation of the longitudinal groove 39. Alternatively, this notch 41 need not be in the continuation of the cavity 24 or of the longitudinal groove 39. The notch 41 makes it possible to lead the flow of product flowing from the cavity 24 towards the application element 6.

The facing surfaces 44 of the branches 30 are spaced apart by a distance d which is a minimum in the median plane M, being, for example, of the order of 1 mm, and the surfaces 44 move away from one another towards the outside from the median plane M as can be seen in FIG. 7.

The length of the slot 36 is, for example, greater than or equal to 10 mm.

The application element 6 is, for example, a bunch of hairs which is folded back on itself and clamped at mid-length in the bottom of the housing 14.

As illustrated in FIG. 3, the largest transverse dimension D of the rod 5 at the top of the intermediate portion 22 is, for example, greater than or equal to 5 mm, being, for example, of the order of 7 mm in the described example. The largest transverse dimension D is strictly less than the smallest internal diameter of the neck.

It can be seen in FIG. 4 that the rod 5 can have, in a plane perpendicular to the median plane M, a width decreasing in the direction of its distal end 40.

The intermediate portion 22 is relatively rigid, not substantially deforming during use of the applicator 3.

When the latter is in place on the container 2, as illustrated in FIG. 1, the rod 5 can be immersed or not in the composition P. When the level of the composition is insufficient to reach the cavity 24, the user can shake the device 1 before use.

The composition is retained, at least temporarily, by capillary action in the cavity 24 and can reach the application element 6 as the latter is moved over the region to be treated, for example, the nails. The intermediate portion 22 does not substantially deform during its withdrawal from the container 2, and, for example, during passage through the neck 10. Thus, the amount of product that can be retained in the cavity 24 is not reduced as a result of extraction of the applicator from the container.

The composition that leaves the cavity 24 can flow easily, by virtue of the inclined surfaces 38, on the grooves 39 and reach the application element 6 from the outside.

The level of composition in the cavity 24 can fall as application progresses and, if applicable, the user can, by observing the rod 5, know whether it should be reloaded by putting it back into the container 2.

For example, the cavity 24 is a through cavity over at least more than half of its length along the axis of the rod 5, and opens onto two opposite outer sides of the outer surface of the rod.

In the described example, the cavity 24 allows the applicator 3 to take away an amount of composition sufficient to treat several nails, for example, all the nails of one hand, perhaps even of two hands, without the user having to re-immerse the applicator 3 in the container 2.

The application element 6 can have an overall flat shape in cross-section and the grooves 39 then make it possible to bring the composition into a middle region of the application element, which allows the composition to be distributed well over the application element 6 and facilitates the obtaining of quality make-up.

Various modifications can be made to the applicator 3 without departing from the scope of the present invention.

For example, the two inclined surfaces 38 of FIG. 5 can be replaced by a single inclined surface 38, as illustrated in FIG. 8.

The rod 5 can include more than two branches, for example, three branches 30 as illustrated in FIG. 9, the cavity 24 being formed between these branches 30 in a central region of the applicator, as can be seen in FIG. 10.

Figure 11:
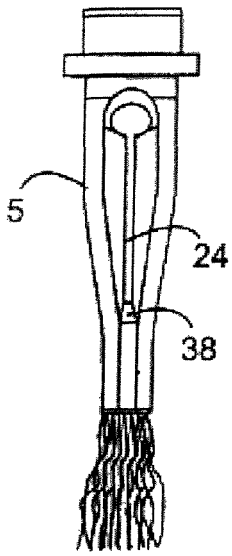

The application element 6 can, for example, include a mixture of hairs having different natures and/or sizes. The application element 6, when it includes a bunch of hairs, can include, for example, wavy hairs, as illustrated in FIG. 11. The bunch can include straight hairs and wavy hairs, for example, a mixture of wavy hairs having different wave frequencies. This can improve the retention of the composition on the bunch of hairs and/or make it possible to regulate the flow rate of applied composition more easily.

Figure 12:
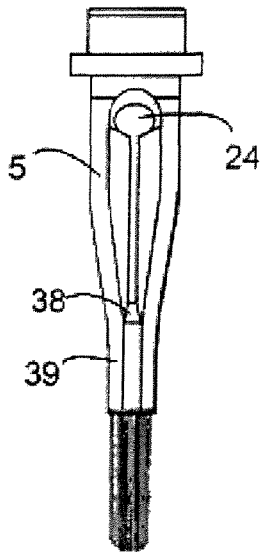
Figure 13:
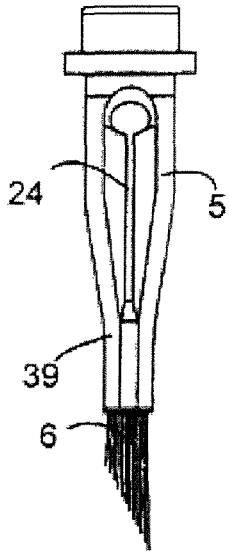
Figure 14:
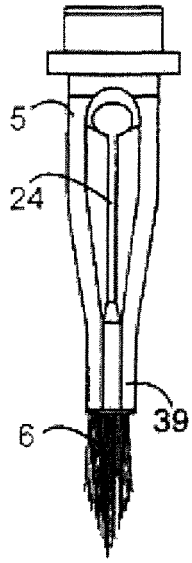

The shape of the application element 6 at its free end can be substantially plane and perpendicular with axis X, as illustrated in FIG. 3, rounded as illustrated in FIG. 12, with a single chamfer as depicted in FIG. 13 or with a double chamfer as depicted in FIG. 14.

The shape of the housing 14 that accommodates the application element 6 can, for example, when the latter includes a bunch of hairs, have a shape contributing towards giving the hairs particular orientations when they leave the rod 5.

Figure 15:
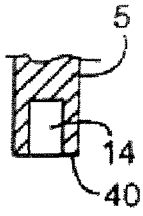
Figure 16:
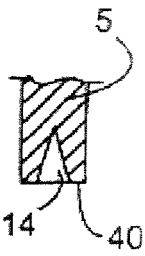
Figure 18:
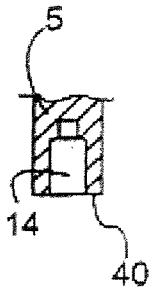
Figure 17:
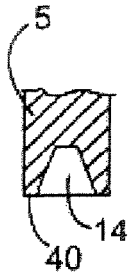
Figure 19:
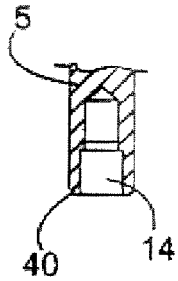
Figure 20:
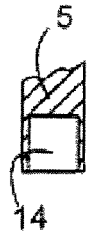
Figure 21:
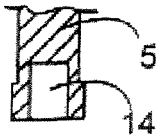

FIGS. 15 to 21 depict different examples of housings 14. The latter can have, for example, a cylindrical shape, of circular section or not, for example, flat as illustrated in FIGS. 15 and 20, conical or tapered as illustrated in FIGS. 16 and 17 or stepped as illustrated in FIGS. 18 and 19. The wall of the rod 5 around the housing need not be constant, as illustrated in FIG. 21, in order, for example, to facilitate the deformation of the rod by stamping.

The application element 6 can be fixed by clamping in the housing 14 or be fixed differently, being, for example, glued, welded, overmolded, press-fitted or snapped on, according to its nature, for example.

Figure 47:
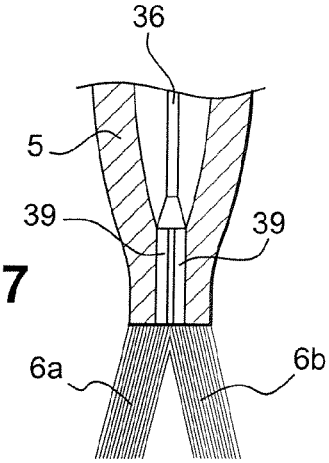

As shown on FIG. 47, the applicator 6 can include at least two bundles of hairs 6*a* and 6*b*, for example, diverging from one another. Those two bundles of hairs can be obtained by inserting two bunch of hairs into the housing 14, or it can be the fact of a particular interior configuration of the housing 14.

Figure 22:
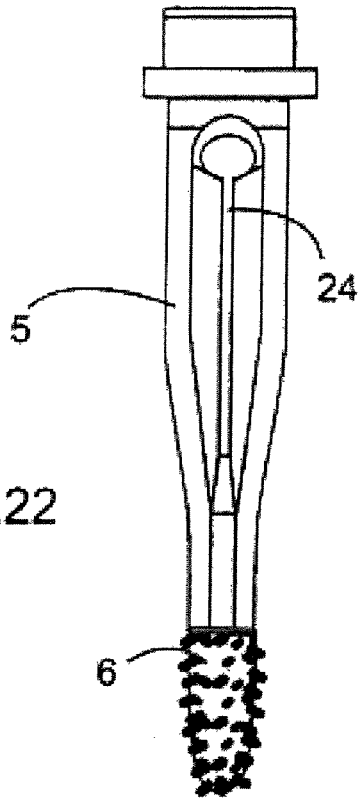
Figure 23:
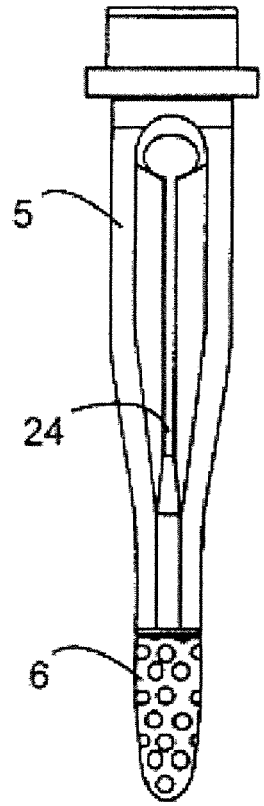
Figure 24:
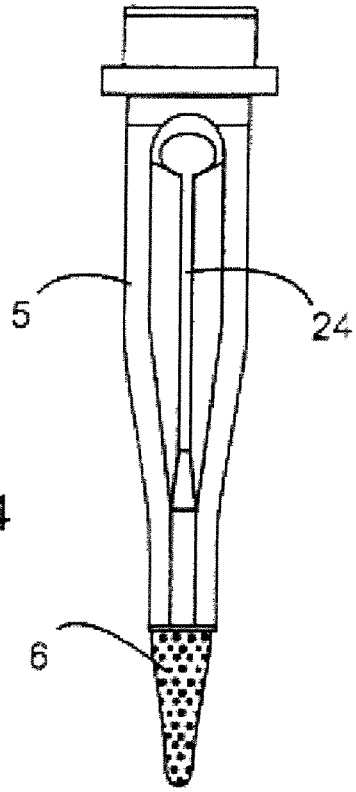
Figure 25:
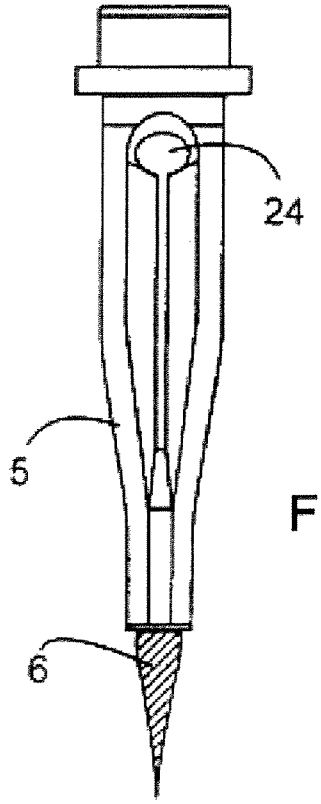

The application element 6 can be other than a bunch of hairs and include flocking as illustrated in FIG. 22, foam as illustrated in FIG. 23, sintered material as illustrated in FIG. 24 or a felt pen as illustrated in FIG. 25.

The application element 6 can extend along a longitudinal axis Z which makes a non-zero angle β with the axis X, as illustrated in FIG. 26.

The distal portion 13 of the rod 5 can, for example, be bent at an angle to that end.

The application element 6 can also be curved, as illustrated in FIG. 27.

The distal portion 13 of the rod 5 can be stamped, in order to give the housing 14 a particular shape, for example, a shape difficult to obtain by molding or making clamping difficult, as illustrated in FIG. 28. This can make it possible to obtain a bunch of hairs with a very flat section as illustrated in FIG. 28A, wavy as illustrated in FIG. 28B, or curved as illustrated in FIG. 28C.

The application element 6 can also be made in a single piece, by molding with the rod 5, as illustrated in FIG. 29. This figure also illustrates the possibility of the application element being perforated and the possibility of the rod including more than one slot 36, for example, two slots 36, which can meet at the end.

The cavity 24 can be given yet other shapes, for example, a shape substantially that of a drop of water as illustrated in FIG. 30, arranged to allow retention of the composition by capillary action.

If applicable, the cavity 24 can be a non-through cavity or be through only in its upper part, for example, in the region of the hole 34, the branches 30 being, for example, joined by a web of material 110 along the slot 36 or on one side of the rod 5, as illustrated in FIG. 42.

The rod 5 can be surrounded by a sheath 60, as illustrated in FIG. 31, which includes, for example, an air inlet aperture 61. The sheath 60 is, for example, fixed at its upper end to an annular region 62 of the rod 5, adjacent to the platform 20.

The application element 6 can be loaded with the composition by being immersed in the container containing said composition.

In a variant, as illustrated in FIGS. 32 to 37, the cavity 24 can be supplied with product from a second container 2 which is fixed to the applicator 3 and which serves, for example, as a gripping member during application.

The rod 5 can then include an internal channel 70 which allows the composition dispensed by the container 2 to reach the cavity 24, this internal channel 70 opening, for example, into the hole 34.

According to the variants depicted in FIGS. 32 to 37, the container forms a cover 72 which can collect excess composition present on the applicator and avoid the composition drying thereon. It is this cover 72 which then has the characteristics of the container according to the invention of the examples of FIGS. 1, 32, 37 and 39.

In the example of FIG. 31, the rod 5 is surrounded by the sheath 60, but the latter can be eliminated, as illustrated in FIGS. 34 and 37.

In order to load the application element 6 with product, the user can, for example, press at least one deformable wall of the container 2.

The rod 5 is connected at the top, in the example of FIG. 34, to a sleeve 80, in which the container 2 can slide. The latter is provided with a dispensing device 81 such as a pump or valve, and at its upper end extends beyond the sleeve 80 so that the user, by pressing the upper end 83 of the container 2, can cause the dispensing of a measure of composition via a hollow rod 84 opening into the internal channel 70.

The rod 5 can be partially covered by the gripping member of the applicator.

In the example of FIG. 35, the rod 5 is partially covered by a lower extension of the aforementioned sleeve 80.

The container containing the composition P can be provided, as applicable, as illustrated in FIG. 39, with a wiping member 90 which makes it possible to remove excess product present on the surface of the rod and/or of the application element 6. This wiping member is configured to make it possible for a flow of air to be maintained around the intermediate portion 22 as it passes through this member 90, for example, during the change from the closed position to the open position.

The rod 5 can be provided with a hinge 120, which defines an articulation axis R, for example, substantially parallel to the median plane M, as illustrated in FIG. 40, or substantially perpendicular thereto, as illustrated in FIG. 41. The axis R can be substantially perpendicular to the axis X.

Figure 44:
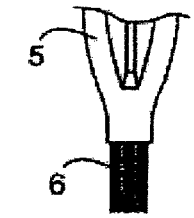
Figure 43:
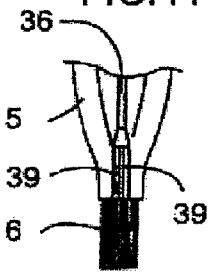

The slot 36 can also open onto several grooves 39, as illustrated in FIG. 43, or onto a smooth surface, as illustrated in FIG. 44.

The invention is not limited to the examples that have just been described. For example, the characteristics of the different example implementations that have just been described can be combined with one another.

The invention is not limited to the application of a make-up and/or care product on the nails and the composition can be intended to be applied on the skin or the lips.

The particular implementation features of the different examples illustrated can be combined with one another. For example, the single slot of certain examples can be replaced by several slots. The expression "including a" must be understood as being synonymous with "including at least one", unless the contrary is specified.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. A packaging and application device comprising:

a composition; and an applicator including an application element, and a rod including a first portion that includes at least two branches, wherein the at least two branches form at least one cavity therebetween, the cavity including at least one slot that extends towards the application element along a longitudinal direction of the rod, wherein the slot is defined in a direction perpendicular to the longitudinal direction of the rod by facing surfaces of the at least two branches, the facing surfaces of the at least two branches are spaced apart from each other in the direction perpendicular to the longitudinal direction of the rod, and the facing surfaces of the at least two branches extend obliquely with respect to each other, and wherein the cavity is delimited in the longitudinal direction at a distal end of the cavity by at least one inclined surface extending towards an outer surface of the rod and towards a distal end of the rod, the inclined surface extends obliquely with respect to a longitudinal axis of the rod, and the inclined surface extends obliquely with respect to the facing surfaces of the at least two branches.

2. The device according to claim 1, further comprising a container, wherein the first portion is disposed in the container in a closed position of the device, and wherein the first portion and the container are configured so that a flow of air is maintained around the first portion during a change from the closed position to an open position, in which the application element is removed the container.

3. The device according to claim 2, further comprising a container in which the composition is contained.

4. The device according to claim 3, wherein the applicator is configured to be removably attached to the container.

5. The device according to claim 3, wherein the applicator is configured to close the container in a sealed manner.

6. The device according to claim 3, wherein the container is devoid of a wiping member.

7. The device according to claim 3, further comprising a second container containing a product that is fixed to the applicator during application.

8. The device according to claim 7, wherein the second container includes a dispensing device.

9. The device according to claim 7, wherein the dispensing device is a valve.

10. The device according to claim 7, wherein the dispensing device is a pump.

11. The device according to claim 7, wherein the second container includes at least one flexible wall configured to deform and dispense the composition.

12. The device according to claim 3, wherein the container forms a cover configured to be fixed on the applicator around the application element.

13. The device according to claim 2, wherein the first portion is configured to be substantially non-deformable during the change from the closed position to the open position.

14. The device according to claim 2, wherein a maximum cross-section of the first portion is smaller than an internal cross-section of a smallest of the cross-sections of the container that the first portion passes through during the change from the closed position to the open position.

15. The device according to claim 1, wherein the first portion is configured to be substantially non-deformable during application of the composition.

16. The device according to claim 1, wherein the rod includes a housing in which the application element is fitted.

17. The device according to claim 16, wherein the housing accommodating the application element does not communicate with the at least one cavity.

18. The device according to claim 1, wherein the at least one cavity extends through the rod.

19. The device according to claim 1, wherein the rod includes a cross-section, along the first portion, of overall oblong shape, elongated in a median plane.

20. The device according to claim 1, wherein the rod includes at least two slots.

21. The device according to claim 1, wherein the rod includes two lateral slots meeting at an end of the rod.

22. The device according to claim 1, wherein the at least one slot extends over more than half the length of the rod.

23. The device according to claim 1, wherein the at least one slot extends over more than 10 mm.

24. The device according to claim 1, wherein the at least one slot opens at a top of the rod into a hole wider than the at least one slot.

25. The device according to claim 1, wherein the at least one cavity extends over more than 10 mm.

26. The device according to claim 1, wherein the at least one cavity extends over more than half the length of the rod.

27. The device according to claim 1, wherein the at least one cavity is configured to extend at a distance from a distal portion of the rod of more than 10 mm from the distal portion.

28. The device according to claim 1, wherein the rod includes at least one longitudinal groove between the at least one cavity and the application element.

29. The device according to claim 1, wherein the rod has two branches.

30. The device according to claim 1, wherein the distance between the facing surfaces is less than or equal to 2 mm.

31. The device according to claim 1, wherein the distance between the facing surfaces is less than or equal to 1.5 mm.

32. The device according to claim 1, wherein the distance between the facing surfaces is on the order of 1 mm.

33. The device according to claim 1, wherein the rod includes a transverse dimension greater than or equal to 5 mm.

34. The device according to claim 1, wherein the rod includes a transverse dimension greater than or equal to 6 mm.

35. The device according to claim 1, wherein the rod includes a transverse dimension greater than or equal to 7 mm.

36. The device according to claim 1, wherein the at least one cavity is delimited in the longitudinal direction of the rod at a bottom of the at least one cavity by at least one inclined surface extending towards an outer surface of the rod and towards a distal end of the rod.

37. The device according to claim 36, wherein the at least one cavity is delimited in the longitudinal direction of the rod at the bottom of the least one cavity by two inclined surfaces that are symmetrical with respect to a median plane of the rod.

38. The device according claim 1, wherein the first portion includes a decreasing overall cross-section in a direction of a distal end of the rod.

39. The device according to claim 1, wherein the rod is formed from a single piece by molding a thermoplastic material.

40. The device according to claim 1, wherein the rod includes three branches forming the at least one cavity therebetween.

41. The device according to claim 1, wherein the application element includes a bunch of hairs.

42. The device according to claim 41, wherein the bunch includes a mixture of hairs.

43. The device according to claim 41, wherein the bunch includes wavy hairs.

44. The device according to claim 43, wherein the bunch includes straight hairs and wavy hairs.

45. The device according to claim 43, wherein the bunch includes wavy hairs with different wave frequencies.

46. The device according to claim 41, wherein the bunch of hairs have a substantially flat overall shape in cross-section.

47. The device according to claim 41, wherein the bunch of hairs include an overall rectangular, square, oval, circular, wavy or curved shape in cross section.

48. The device according claim 1, wherein the application element includes flocking, felt, foam, sintered material or a textile.

49. The device according to claim 1, wherein the first portion includes a single cavity.

50. The device according to claim 1, wherein the applicator includes a sheath surrounding the rod.

51. The device according to claim 1, wherein the application element is molded at least partially in a single piece with the rod.

52. The device according to claim 51, wherein the application element is flocked or covered with a textile or foam.

53. The device according to claim 1, wherein the application element is positioned so that a longitudinal axis of the application element makes a non-zero angle with a longitudinal axis of the rod.

54. The device according to claim 1, wherein the applicator includes a hinge.

55. The device according to claim 54, wherein the hinge is a film hinge.

56. The device according to claim 1, wherein the application element extends from the rod in a direction that is not substantially parallel to a longitudinal axis of the rod.

57. The device according to claim 56, wherein the application element is curved.

58. The device according to claim 56, wherein the application element makes an angle with the longitudinal axis of the rod.

59. The device according to claim 1, wherein the at least one cavity extends on only a single side of the rod over at least part of the length of the at least one cavity.

60. The device according to claim 1, wherein the at least one slot opens onto only one side of the rod.

61. The device according to claim 1, wherein the application element partially externally covers the rod.

62. The device according to claim 1, wherein the at least one slot opens onto an outer surface of a distal portion of the rod.

63. The device according to claim 62, wherein the distal portion of the rod is devoid of longitudinal grooves.

64. The device according to claim 62, wherein the distal portion of the rod has a flat external shape.

65. The device according to claim 1, wherein the at least one slot opens onto several longitudinal grooves that do not extend entirely through the rod.

66. The device according to claim 1, wherein the composition is suitable for application on the nails.

67. The device according to claim 1, wherein the composition is suitable for application on the nails, skin, or lips.

* * * * *